United States Patent [19]

Bosne

[11] Patent Number: 4,631,213

[45] Date of Patent: Dec. 23, 1986

[54] THERMOFORMED SHEET FOR A PLATE-TYPE GAS-GAS HEAT EXCHANGER AND THE EXCHANGER INCLUDING SAID SHEET

[75] Inventor: Georges J. P. E. Bosne, Viroflay, France

[73] Assignee: Hamon-Industries, Paris, France

[21] Appl. No.: 757,128

[22] Filed: Jul. 19, 1985

[51] Int. Cl.[4] ..... B32B 3/28

[52] U.S. Cl. ..... 428/53; 428/54; 428/121; 428/174; 428/177; 428/178; 428/188; 428/192

[58] Field of Search ..... 428/53, 54, 121, 174, 428/177, 178, 188, 192

[56] References Cited

U.S. PATENT DOCUMENTS

| | | | |
|---|---|---|---|
| 3,669,821 | 6/1972 | Sharp | 161/127 |
| 4,080,245 | 3/1978 | Yamanaka et al. | 156/647 |
| 4,537,812 | 8/1985 | Elbers | 428/182 |
| 4,588,631 | 5/1986 | Clark | 428/166 |

*Primary Examiner*—John E. Kittle
*Assistant Examiner*—Patrick J. Ryan
*Attorney, Agent, or Firm*—Walter H. Schneider

[57] ABSTRACT

A thermoformed sheet 1 for a plate-type gas-gas heat exchanger of the type comprising a case in which are stacked parallel plates spaced from each other by lateral spacing means, these plates having at their ends pointed regions provided with elements for alternately closing one of the two sides of the point, the case further comprising walls connected in a fluidtight manner to the pointed portions of the ends of the plates so as to form distinct inlet and outlet conduits for the gases which circulate in a countercurrent manner in the alternating spaces formed by the plates, this sheet being characterized in that it comprises a series of identical rows of elongated patterns 2*a*, 2*b*, 2*c*, 2*d* having edge portions folded on one side or the other of the sheet, each pattern comprising two parallel longitudinal edge portions 3*a*, 4*a*; 3*b*, 4*b*; 3*c*, 4*c*, 3*d*, 4*d* by which it is connected to the adjacent patterns so as to form a row and terminating in two pointed end portions 8*a*, 9*a*; 8*b*, 9*b*; 8*c*; 9*c*; 8*d*, 9*d* by which the patterns of one row are connected to the patterns of the following row, intermediate regions 13, 14, 15, 16, 17 existing between these rows alternately projecting from one side and the other of the sheet 1.

5 Claims, 14 Drawing Figures

THERMOFORMED SHEET FOR A PLATE-TYPE GAS-GAS HEAT EXCHANGER AND THE EXCHANGER INCLUDING SAID SHEET

The present invention relates to plate-type gas-gas heat exchangers, and more particularly to a thermoformed sheet for producing plates for such exchangers.

Plate-type exchangers are used, in particular, for heating the fresh air entering a building by means of the viciated air which is extracted from the building, and permit heating economies to be achieved.

An object of the present invention is to permit producing in large numbers and cheaply plate-type gas-gas exchangers so as to satisfy the needs in economy of energy.

Plate-type gas-gas heat exchangers are already known which are of the type comprising a case in which are stacked parallel plates which are spaced apart from one another by lateral spacing means, these plates comprising at their ends pointed-shape regions provided with elements for alternately closing one of the two sides of the points, the case further comprising walls which are connected in a sealed manner to the points of the ends of the plates in such manner as to form distinct inlet and outlet conduits for the gases which flow in a countercurrent manner in the alternating spaces formed by the plates.

Exchangers of this type are disclosed in particular in the patents FR- 1 272 343 and FR- 2 315 174. These exchangers however employ plates of complex shape whose manufacture is difficult and this in practice precludes a large scale production.

An object of the present invention is to overcome these drawbacks and to provide in a simple and cheap manner a sheet for forming plates for heat exchangers.

The sheet according to the present invention comprises a series of identical rows of elongate patterns having edges folded on one side or the other of the sheet, each pattern comprising two parallel longitudinal edges by which it is connected to the adjacent patterns so as to form a row and terminating in two pointed end portions by which the patterns of one row are connected to the patterns of the following row, the intermediate regions existing between these rows projecting alternately from one side and the other of the sheet.

The sheet according to the present invention is produced by a thermoforming operation, in particular by a continuous thermoforming operation, by means of a mould whose length equals the length of the repetitive part. It may also be constructed sheet by sheet by means of a conventional machine with a mould which is sufficiently large to contain a sufficient number of rows.

The sheets according to the invention are advantageously made from a thermoplastic material, and for example polyvinyl chloride.

The plates employed for constructing a heat exchanger are obtained by cutting out each pattern, or an assembly of patterns inscribed in a rectangle, in the region of the connecting regions of the patterns of the same row and in the region of the edges of the intermediate regions existing between the rows.

Thus, by the choice of the cutting out, it is possible to obtain plates of a size adapted to the size of the desired exchanger and consequently to produce exchangers which correspond to very varied gas flows.

This cutting out may be effected directly at the output end of the thermoforming machine.

In a preferred embodiment of the invention, the sheet has patterns whose parallel longitudinal edges are folded on the same side of the sheet. In order to produce an exchanger according to the invention, the patterns or an assembly of these patterns are stacked by separating them with planar sheets.

In another embodiment of the invention, the sheet has patterns whose longitudinal edges are folded on the side of the sheet where the contiguous intermediate regions project. Thus, the longitudinal edges in a row are alternately folded on one side and the other of the sheet in phase with the edges of the intermediate regions.

Further, the use of thermoforming for producing the sheet according to the invention permits the manufacture of sheets having particularly designed asperities for creating turbulences in the gases. These turbulences are of interest since they increase the effectiveness per square metre of exchange surface. Likewise, the sheet may receive, by a thermoforming operation, bosses adapted to maintain the separation of the sheets/notwithstanding a pressure difference which may exist between the two gas circuits.

The invention will be described hereinafter in more detail with reference to the drawings which represent only embodiments of the invention.

Figure 11:
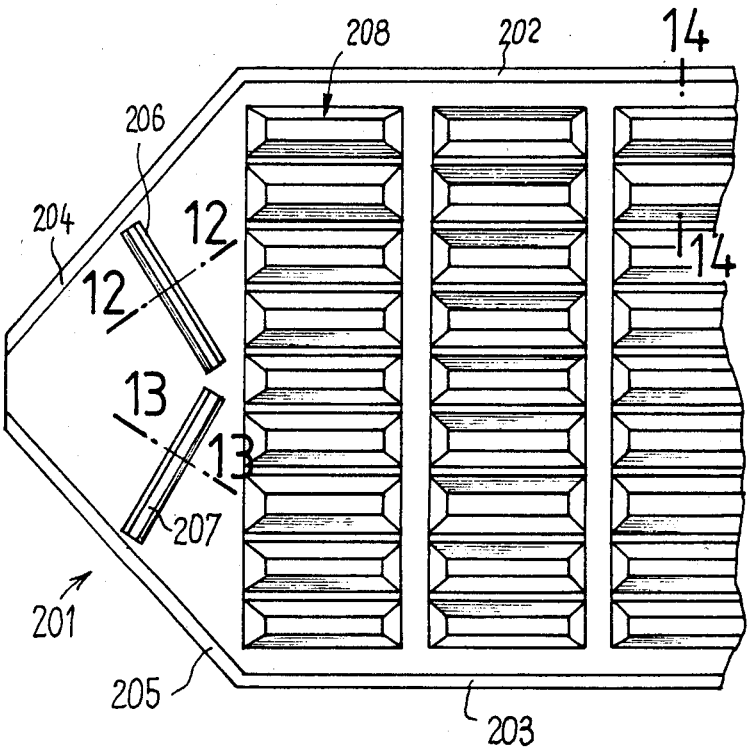
FIG. 11 is a top plan view of a pattern including goffering.
Figure 12:
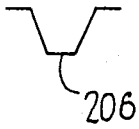
Figure 13:
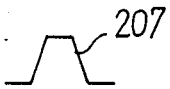
Figure 14:
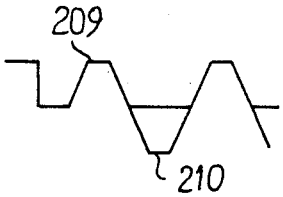

FIGS. 12, 13 and 14 are sectional views taken on line 12—12, 13—13, and 14—14, respectively, of FIG. 11.

Figure 1:
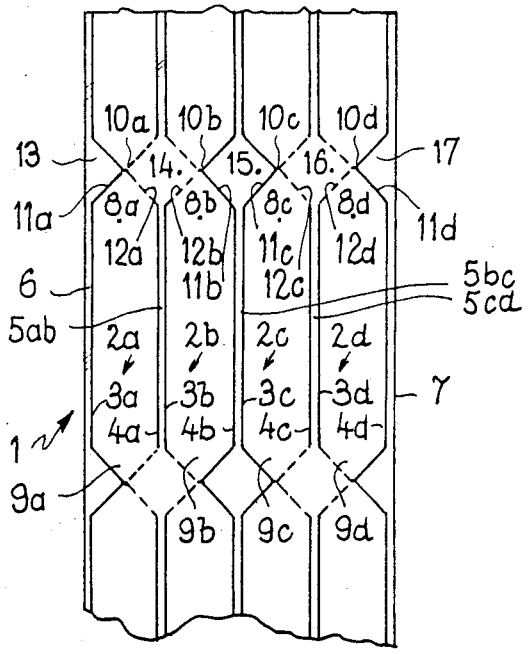
FIG. 1 is a top plan view of a sheet according to the invention, in which the limit of the hollow part is shown by dotted lines.

The sheet 1 shown in FIG. 1 is a sheet of a thermoformed thermoplastic material. It includes in the longitudinal direction of the sheet a series of identical rows of four patterns 2*a*, 2*b*, 2*c* and 2*d*.

Each of the patterns of a row has the shape of a hexagon which is elongated in the longitudinal direction of the sheet 1 and includes two longitudinal parallel edges of the same height folded at a right angle upwardly of the sheet 1, namely 3*a* and 4*a*, 3*b* and 4*b*, 3*c* and 4*c*, 3*d* and 4*d*, respectively.

The edge portions 4*a* and 3*b*, 4*b* and 3*c*, 4*c* and 3*d* are connected by narrow longitudinal regions 5*ab*, 5*bc*, 5*cd* respectively which are parallel to the plane of the sheet 1. As concerns the lateral longitudinal edge portions 3*a* and 4*d*, they are provided with flanges 6 and 7, respectively, which are parallel to the plane of the sheet.

Each of these patterns terminates in end regions 8*a* and 9*a*, 8*b* and 9*b*, 8*c* and 9*c*, 8*d* and 9*d* respectively, which have the shape of an isosceles triangle, and which thus impart to each pattern the shape of an elongate hexagon.

The patterns of the same row are connected by the points 10*a*, 10*b*, 10*c*, 10*d* of the end regions 8*a*, 8*b*, 8*c*, 8*d* to the identical patterns of the following row.

Each end region, such as 8*a*, 8*b*, 8*c*, 8*d*, has an edge portion 11*a*, 11*b*, 11*c*, 11*d* which is folded at a right angle upwardly of the sheet, and an edge portion 12*a*, 12*b*, 12*c*, 12*d* which is folded at a right angle downwardly of the sheet. These edge portions have the same height as the longitudinal edge portions, such as 3*a* and 4*a*. In one row, the edge portions folded upwardly and downwardly are disposed in such manner that the folded edge portions of the same side are adjacent. Thus, the edge portions 12*a* and 12*b* which are folded downwardly are adjacent. In this way, there are obtained between two successive rows intermediate regions 13, 14, 15, 16 and 17 which project alternately above and below the sheet. The regions 13 and 17 which are at the edge of the sheet have the shape of an isosceles triangle, whereas the other intermediate regions have the shape of a diamond.

Figure 2:
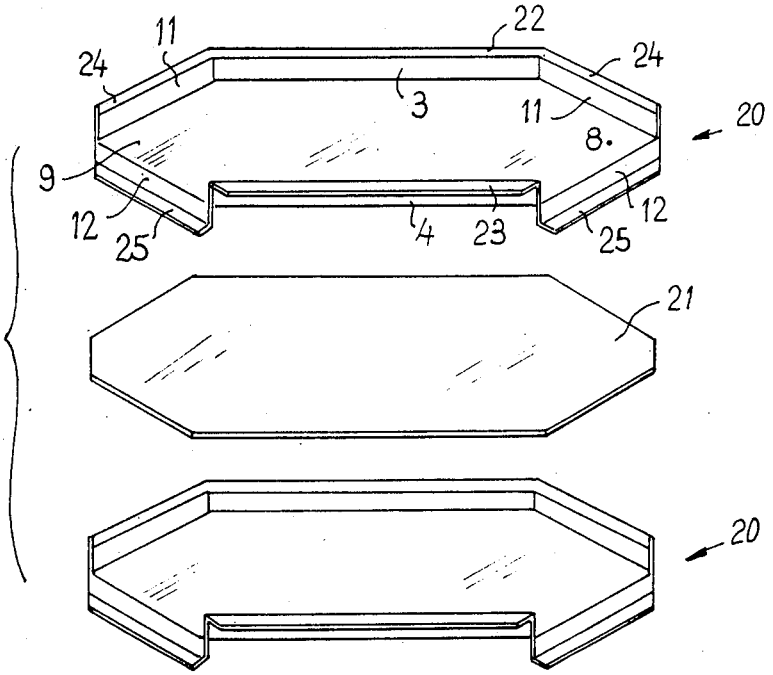
FIG. 2 is a perspective view of the elements of a stack comprising patterns of the sheet shown in FIG. 1, adapted to constitute a heat exchanger.

FIG. 2 shows elements for constituting a stack producing a heat exchanger according to the invention.

These elements comprise, on one hand, thermoformed plates 20 obtained from patterns of the sheet 1 and, on the other hand, planar plates 21.

Each plate 20 is obtained by cutting out the sheet 1 longitudinally in the middle of the narrow longitudinal regions such as 5, 6, 7, so as to form flanges 22 and 23 which are parallel to the plane of the sheet and respectively adjacent to the longitudinal edge portions 3 and 4 and to the end regions 8 and 9 while leaving flanges 24 and 25 parallel to the plane of the sheet, of the same width as the flanges 22 and 23, and respectively adjacent to the edge portions 11 and 12, one of which is folded upwardly of the sheet, whereas the other is folded downwardly of the sheet.

The planar plates 21 have a shape corresponding in projection to the shape of the plates 20.

Figure 3:
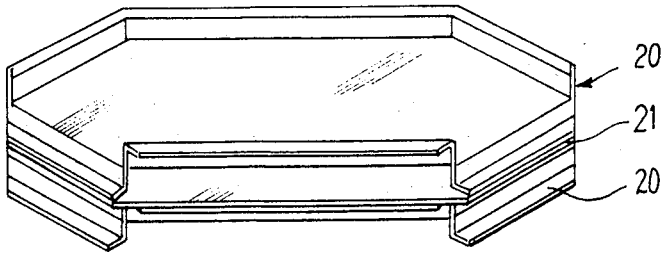
FIG. 3 is a view similar to FIG. 2 after assembly.

In order to assemble the thermoformed plates 20 and the planar plates 21, as shown in FIG. 3, an adhesive is applied to the parts of the flanges 22, 23 and 24 of a first plate 20 facing upwardly of the sheet, and a planar plate 21 is applied and then a second plate 20, all of whose flanges 25, 24, 22 and 23 have received an adhesive, is applied, and the stacking is pursued. In order to adhere sheets of polyvinyl chloride, adhesives based on polyvinyl chloride containing organic solvents may be in particular employed.

By way of a modification, the flanges of the thermoformed plates may be thermowelded with the planar plates.

Figure 4:
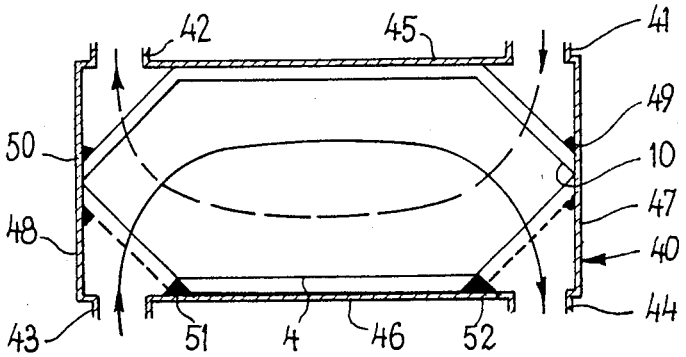
FIG. 4 is a sectional view, seen from above, of a heat exchanger comprising a stack according to that shown in FIG. 3.

The stack thus obtained is placed, as shown in FIG. 4, in a case 40 in the shape of a right-angled parallelepiped. This case 40 includes conduits 41 and 42 for the inlet and outlet of a first gas, and the conduits 43 and 44 for the inlet and outlet of a second gas. These conduits are connected to the vertical longitudinal surfaces 45, 46 in the vicinity of the vertical end surfaces 47 and 48. The fluidtightness of the two gas circuits is ensured by vertical sealing elements 49 and 50 which are disposed between the walls 47 and 48 and the points 10 of the plates of the stack, vertical sealing elements 51 and 52 which are disposed between the walls 46 and the end of the edge portions 4, and horizontal sealing elements (not shown).

The first gas (the path shown in dotted line) enters for example through the conduit 41 and passes between every other of the passages defined by the plates 20 and 21, namely the passages defined between a plate 21 and a plate 20 disposed above, and issues through the conduit 42.

The second gas (path shown in full line) enters through the conduit 43, passes between other passages defined by the plates, namely the passages defined between the plate 20 and the plate 21 disposed above, and issues through the conduit 44.

In these passages, the second gas circulates in a countercurrent manner with respect to the first gas which circulates in the other passages.

Figure 5:
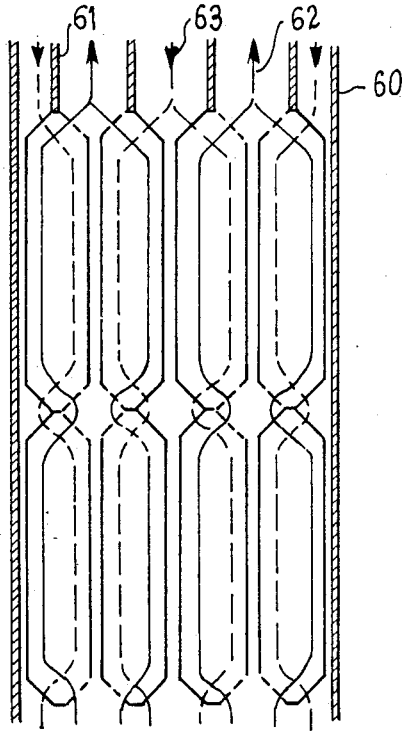
FIG. 5 is a sectional view, seen from above, of a part of an exchanger comprising a group of patterns of the sheet shown in FIG. 1.

The heat exchanger shown in FIG. 5 comprises a stack of an assembly of patterns of the sheet shown in FIG. 1. In the illustrated case, the sheet is employed in its full width and the assembly comprises a plurality of rows of patterns, for example three rows of four patterns. It will be understood that it is also possible to obtain heat exchangers of different size by cutting out a different number of rows and by cutting out the sheet so as to obtain a smaller number of patterns in a row.

In order to produce the exchanger shown in FIG. 5, the sheets cut out from the sheet shown in FIG. 1 are assembled as described for the stack of a plate comprising a single pattern, i.e. by interposing therebetween planar sheets of the same dimension and by adhering the edge portions surrounding the patterns of the thermoformed sheets to the planar sheets.

The assembly comprising the stack of sheets is disposed in a case 16 having a right-angled parallelepiped shape.

Disposed at the end of the stack are vertical walls 61 which are connected in a sealed manner to the points 10 of the end patterns so as to form distinct spaces, such as 62 and 63, for respectively supplying a first gas and discharging a second gas.

As in the case shown in FIG. 4, the first gas (path shown in dotted lines) passes into the passages defined between a planar sheet and a thermoformed sheet 1 disposed thereabove, while the second gas (path shown in continuous lines) circulates in a countercurrent manner in the passages defined between a thermoformed sheet 1 and a planar sheet disposed thereabove.

Figure 6:
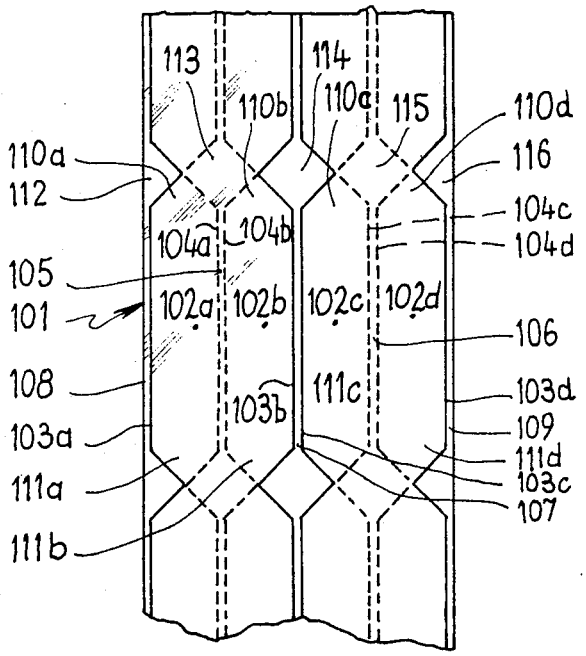
FIG. 6 is a top plan view of another sheet according to the invention, in which the limits of the hollow parts are shown in dotted lines.

FIG. 6 shows another thermoformed sheet 101 according to the invention.

As the sheet 1, the sheet 101 has, in the longitudinal direction, a series of identical rows of four patterns 102*a*, 102*b*, 102*c*, 102*d* respectively.

Each of the patterns of a row has the shape of a hexagon elongated in the longitudinal direction of the sheet and includes two longitudinal parallel edge portions which are of the same height and folded at a right angle, namely one upwardly of the sheet (103*a*, 103*b*, 103*c*, 103*d*) and the other downwardly of the sheet (104*a*, 104*b*, 104*c*, 104*d*).

The edge portions 104*a* and 104*b* on one hand, and 104*c* and 104*d*, on the other hand, are juxtaposed and are connected in narrow longitudinal regions 105 and 106 respectively which are parallel to the plane of the sheet and are located under the latter.

The edge portions 103*b* and 103*c* are juxtaposed and are connected in a narrow longitudinal region 107 which is parallel to the plane of the sheet and located above the latter.

As concerns the lateral edge portions 103*a* and they are provided with flanges 108 and 109.

Each of the patterns 102*a*, 102*b*, 102*c* and 102*d* terminates in end regions 110*a*, and 111*a*, 110*b* and 111*b*, 110*c* and 111*c*, 110*d* and 111*d* respectively, which are similar to the end regions 8*a* and 9*a*, 8*b* and 9*b*, 8*c* and 9*c*, 8*d* and 9*d* of the sheet 1 of FIG. 1.

The patterns of the same row are connected by their pointed portions, as in the case of the sheet 1 of FIG. 1, and define therebetween intermediate regions 112, 113, 114, 115 and 116 respectively similar to the intermediate regions 13, 14, 15, 16 and 17 and projecting alternately upwardly and downwardly of the sheet 101.

Figure 7:
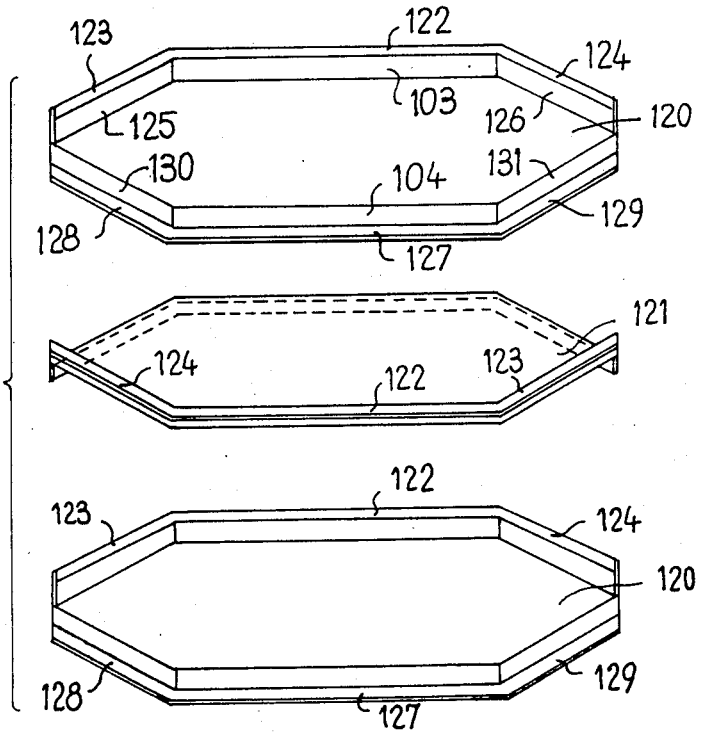
FIG. 7 is a perspective view of the elements of a stack comprising patterns of the sheet shown in FIG. 6.

Elements permitting the formation of a stack for another heat exchanger according to the invention are shown in FIG. 7.

These elements comprise a series of thermoformed plates 120 and 121 which are identical, one of which has merely undergone a rotation of 180° about an axis perpendicular to the plane of the plate. These plates are obtained by a cutting out of the patterns of the sheet 101 which is similar to the cutting out of the plates 20 from the sheet 1.

These plates 120 and 121 are provided with a longitudinal flange 122 and two end flanges 123 and 124, these flanges being respectively adjacent to the end portions 103 and to two end edge portions 125 and 126 which are placed above the plane of the sheet and are themselves parallel to the plane of the latter.

Likewise, the plates 120 and 121 include a longitudinal flange 127 and two end flanges 128 and 129, these flanges being respectively adjacent to the longitudinal edge portions 104 and to the end edge portions 130 and 131 which are bent downwardly of the plane of the sheet, and being themselves parallel to the plane of the sheet.

Figure 8:
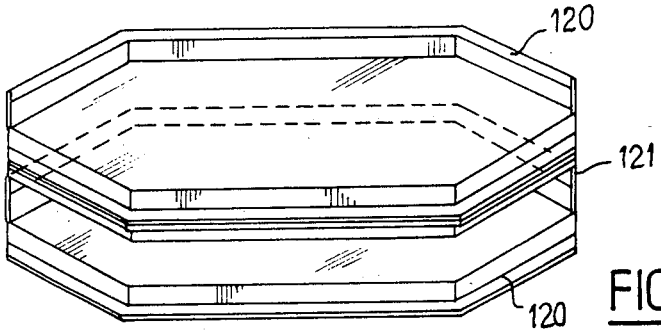
FIG. 8 is a view similar to FIG. 7, after assembly.

The plates 120 and 121 are assembled as shown in FIG. 8 by adhesion of the parts of the flanges 122, 123, 124, 127, 128 and 129, which face outwardly of the sheet.

By way of a modification, these flanges may also be thermowelded.

The stack thus obtained may be placed in a case similar to that shown in FIG. 4 with vertical sealing elements in the region of the pointed portions of the plates and sealing elements between the flanges 123, 122, 124 of the upper plate and the case and between the flanges 128, 127, 129 of the lower plate and the case.

Figure 9:
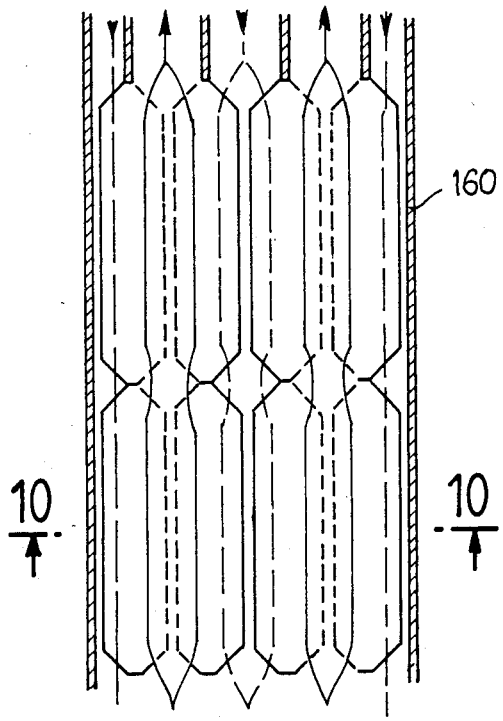
FIG. 9 is a sectional view, seen from above, of a heat exchanger comprising a group of patterns of the sheet shown in FIG. 6.

The heat exchanger shown in FIG. 9 comprises a stack of a group of patterns of the sheet shown in FIG. 6. In the illustrated embodiment, the sheet 101 is used in its full width and the assembly comprises a plurality of rows of patterns. The groups of patterns are stacked after application of an adhesive, and rotation of every other group through 180° about an axis perpendicular to the plane of the sheets. The stack obtained is disposed in a case 160 provided with gas inlet conduits and outlet conduits, as in the case of the embodiment of FIG. 5.

Figure 10:
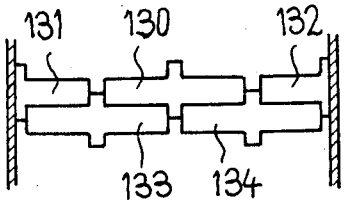
FIG. 10 is a partial sectional view taken on line 10—10 of FIG. 9.

As shown in FIG. 10, the stack obtained defines a succession of passages including alternately a first layer with a double passage 130, and two passages 131 and 132, and a second layer with two double passages 133 and 134. The first gas flows in the first layer and the second gas in the second layer.

A patern 201 of a thermoformed sheet according to the invention which includes goffering on its surface is shown in FIG. 11.

The pattern 201 is similar to the pattern 2 of the sheet 1 and includes longitudinal edge portions 202 and 203 and end edge portions 204 folded upwardly of the sheet and end edge portions 205 folded downwardly of the sheet. The edge portion 205 is thus adjacent to the inlet of the upper passage while the edge portion 204 is adjacent to the outlet of the lower passage. In the vicinity of the outlet of the lower passage, the plate 201 has a rib 206 which projects downwardly of the sheet substantially in the middle of the semi-half of the end portion and disposed at an angle of about 70° with respect to the edge 204, this angle being adjacent to the point.

In the vicinity of the inlet of the upper passage, the plate 201 has a rib 207 similar to the rib 206, but projecting upwardly of the sheet.

These ribs 206 and 207 guide the streams of gas by distributing them over the whole of the surface of the plates.

The central region of the plate 201 includes, moreover, a series of regions 208 having a transverse goffering.

These regions 208 include transversely a succession of bosses 209 and hollows 210 relative to the median plane of the sheet. All of the bosses, hollows and intermediate regions without goffering produces turbulences which encourage the heat exchange.

The main advantages of the present invention are the following:

- it results in high efficiencies (higher than 70%) as calculated according to the standard AFNOR E 51702;
- a single mould of small dimension and therefore cheap, is sufficient to produce all the sizes of the range;
- it is possible to make the sheets from a thermoplastic material, so that the cost of the tooling is still further reduced with respect to that required in the construction with metal sheets;
- the thermoforming moreover permits forming in a cheap manner on the sheet shapes of an infinite variety for quite diverse purposes, as for example:
- creating turbulences so as to increase the efficiency;
- maintaining the spacing between the sheets/constant by means of bosses;
- guiding the gas streams in such manner as to distribute them as uniformly as possible, throughout the section of passage; the gas stream guide may have any shape, for exmple curved, if desired; the sole requirement being that it be possible to strip the sheet from the mould after thermoforming.

I claim:

1. A thermoformed sheet (1 ; 101) for a plate type gas-gas heat exchanger of the type comprising a case (40 ; 60) in which are stacked parallel plates spaced apart from each other by lateral spacing means, these plates having at their ends pointed regions provided with elements for alternately closing one of the two sides of the pointed regions, the case further comprising walls connected in a fluidtight manner to the points of the ends of the plate so as to form distinct inlet and outlet conduits for the gases which circulate in a countercurrent manner in the alternating spaces formed by the plates, this sheet comprising a series of identical rows of elongated patterns (2*a*, 2*b*, 2*c*, 2*d*; 102*a*, 102*b*, 102*c*, 102*d*) having folded edge portions on one side or the other of the sheet, each pattern having two parallel longitudinal edge portions (3*a*, 4*a*; 3*b*, 4*b*; 3*c*, 4*c*; 3*d*, 4*d*; 103*a*, 104*a*; 103*b*, 104*b*; 103*c*, 104*c*; 103*d*, 104*d*) by which it is connected to adjacent patterns so as to form a row and terminating in two pointed end portions (8*a*, 9*a*; 8*b*, 9*b*; 8*c*, 9*c*; 8*d*, 9*d*; 110*a*, 111*a*; 110*b*, 111*b*; 110*c*, 111*c*; 110*d*, 111*d*) by which the patterns of a row are connected to the patterns of the following row, the intermediate regions (13, 14, 15, 16, 17; 112, 113, 114, 115, 116) existing between these rows projecting alternately on one side and the other of the sheet (1, 101).

2. A sheet according to claim 1, in which all the longitudinal edge portions (3*a*, 4*a*; 3*b*, 4*b*; 3*c*, 4*c*; 3*d*, 4*d*) of the patterns are folded on the same side of the sheet (1).

3. A sheet according to claim 1, in which the longitudinal edge portions (103*a*, 104*a*; 103*b*, 104*b*; 103*c*, 104*c*; 103*d*, 104*d*) of the patterns are folded on the side of the sheet where the contiguous intermediate regions (112, 113, 114, 115, 116) project.

4. A sheet according to claim 1, in which the end portions of the patterns (8*a*, 9*a*; 8*b*, 9*b*; 8*c*, 9*c*; 8*d*, 9*d*; 110*a*, 111*a*; 110*b*, 111*b*; 110*c*, 111*c*; 110*d*, 111*d*) have the shape of an isosceles triangle.

5. A sheet according to claim 1, in which each pattern includes goffering.

* * * * *